US011257458B2

(12) United States Patent
Wang

(10) Patent No.: US 11,257,458 B2
(45) Date of Patent: Feb. 22, 2022

(54) DRIVING METHOD AND DEVICE FOR DISPLAY PANEL

(71) Applicant: HKC CORPORATION LIMITED, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,495

(22) PCT Filed: Nov. 28, 2018

(86) PCT No.: PCT/CN2018/117950
§ 371 (c)(1),
(2) Date: Sep. 29, 2020

(87) PCT Pub. No.: WO2020/097983
PCT Pub. Date: May 22, 2020

(65) Prior Publication Data

US 2021/0110785 A1 Apr. 15, 2021

(30) Foreign Application Priority Data

Nov. 12, 2018 (CN) ..... 201811338809.X

(51) Int. Cl.
*G09G 3/36* (2006.01)
*G09G 3/00* (2006.01)

(52) U.S. Cl.
CPC ..... *G09G 3/3696* (2013.01); *G09G 3/006* (2013.01); *G09G 2370/00* (2013.01)

(58) Field of Classification Search
CPC ... G09G 3/3696; G09G 3/006; G09G 2370/00
See application file for complete search history.

(56) References Cited

U.S. PATENT DOCUMENTS 8,736,538 B2 5/2014 Al-dahle
2005/0068276 A1 3/2005 Ho
2007/0285367 A1* 12/2007 Guan ..... G09G 3/3648 345/87

(Continued)

FOREIGN PATENT DOCUMENTS

CN 1949355 A 4/2007
CN 102034439 A 4/2011

(Continued)

OTHER PUBLICATIONS

International Search Report from International Application No. PCT/CN2018/117950 dated Aug. 9, 2019.

*Primary Examiner* — Shaheda A Abdin
(74) *Attorney, Agent, or Firm* — Hauptman Ham, LLP

(57) ABSTRACT

Provided are a driving device and driving method for a display panel. The driving method comprises: firstly, acquiring a target voltage of a first voltage module; secondly, comparing the target voltage with a first pre-set voltage so as to obtain a comparison result; then, the first voltage module outputting, based on the comparison result and the first pre-set voltage, a first common voltage, and sending the comparison result to a second voltage module; finally, the second voltage module outputting, according to the comparison result and a second pre-set voltage, a second common voltage.

20 Claims, 3 Drawing Sheets

(56) References Cited

U.S. PATENT DOCUMENTS

2017/0162100 A1* 6/2017 Chen ..... G09G 3/3655

FOREIGN PATENT DOCUMENTS

| | | | | | |
|---|---|---|---|---|---|
| CN | 104036743 | A | | 9/2014 | |
| CN | 104157251 | A | | 11/2014 | |
| CN | 105096855 | A | | 11/2015 | |
| CN | 105632450 | | * | 6/2016 | ..... G09G 3/3696 |
| CN | 105632450 | A | | 6/2016 | |
| CN | 106504175 | A | | 9/2016 | |
| CN | 106297711 | A | | 1/2017 | |
| CN | 107678213 | A | | 2/2018 | |
| CN | 108761856 | A | | 11/2018 | |
| JP | 2009282109 | A | | 12/2009 | |

* cited by examiner

DRIVING METHOD AND DEVICE FOR DISPLAY PANEL

CROSS REFERENCE TO RELATED APPLICATIONS

This application claims priority to Chinese Patent Application No. 201811338809.X, filed with the Chinese Patent Office on Nov. 12, 2018 and entitled "DRIVING METHOD AND DEVICE FOR DISPLAY PANEL", which is incorporated herein by reference in its entirety.

TECHNICAL FIELD

This application relates to the field of liquid crystal display technologies, and in particular, to a method and device for driving a display panel.

BACKGROUND

The description herein provides only background information related to this application, but does not necessarily constitute the existing technology.

With regard to the problem that a viewing angle of a liquid crystal display panel is not wide enough, it is currently popular to divide a pixel into a main pixel and a sub-pixel, and drop out a voltage of the sub-pixel to a lower level to ensure brightness performance for a side viewing angle. A dual common-electrode (CF-VCOM, Array-VCOM) design is recently proposed for discharging sub-pixels. By dropping out a voltage of a sub-pixel of a liquid crystal to an Array-VCOM voltage, a voltage difference between both ends of the liquid crystal of the sub-pixel is a difference between the Array-VCOM and the CF-VCOM.

Currently, the two VCOM voltages are provided by independent power supplies. However, the voltages are not interlinked. Therefore, a fixed voltage difference cannot be achieved.

SUMMARY

On this basis, with regard to the existing problem that a fixed voltage difference cannot be achieved because two VCOM voltages are not interlinked, a method and device for driving a display panel are provided.

A method for driving a display panel includes:

acquiring a target voltage of a first voltage module;

comparing the target voltage with a first preset voltage to obtain a comparison result;

outputting, by the first voltage module, a first common voltage based on the comparison result and the first preset voltage, and sending the comparison result to a second voltage module; and outputting, by the second voltage module, a second common voltage according to the comparison result and a second preset voltage.

In an embodiment, comparing the target voltage with the first preset voltage to obtain the comparison result includes:

acquiring the first preset voltage; and comparing the first preset voltage with the target voltage to obtain the comparison result.

In an embodiment, comparing the first preset voltage with the target voltage to obtain the comparison result includes:

performing a difference comparison or a division comparison on the first preset voltage and the target voltage to obtain a difference comparison result or a division comparison result.

In an embodiment, outputting, by the first voltage module, the first common voltage based on the comparison result and the first preset voltage, and sending the comparison result to the second voltage module includes:

outputting, by the first voltage module, a first target voltage based on the comparison result and the first preset voltage;

outputting the first common voltage after performing data conversion on the first target voltage; and sending the comparison result to the second voltage module after performing data processing on the comparison result.

In an embodiment, outputting the first common voltage after performing data conversion on the first target voltage includes:

performing digital-to-analog conversion on the first target voltage based on a first preset reference voltage, to obtain the first common voltage; and outputting the first common voltage.

In an embodiment, outputting, by the second voltage module, the second common voltage according to the comparison result and the second preset voltage includes:

acquiring, by the second voltage module, the second preset voltage; and performing, by the second voltage module, data processing on the comparison result and the second preset voltage, and outputting the second common voltage.

In an embodiment, performing, by the second voltage module, the data processing on the comparison result and the second preset voltage, and outputting the second common voltage includes:

outputting, by the second voltage module, a second target voltage based on the comparison result and the second preset voltage; and performing digital-to-analog conversion on the second target voltage based on a second preset reference voltage to obtain the second common voltage, and outputting the second common voltage.

A method for driving a display panel includes:

acquiring a target voltage of a first voltage module;

performing a difference comparison on the target voltage and a first preset voltage to obtain a difference comparison result;

outputting, by the first voltage module, a first common voltage based on the difference comparison result and the first preset voltage, and sending the difference comparison result to a second voltage module after performing data processing on the difference comparison result; and outputting, by the second voltage module, a second common voltage according to the difference comparison result and a second preset voltage.

A device for driving a display panel includes:

a first voltage module, configured to acquire a target voltage and compare the target voltage with a first preset voltage to obtain a comparison result, wherein:

the first voltage module is further configured to output a first common voltage based on the comparison result and the first preset voltage and send the comparison result to a second voltage module; and the second voltage module is communicatively connected to the first voltage module and configured to output a second common voltage according to the comparison result and a second preset voltage.

Compared with the prior art, the method for driving a display panel as described above includes: acquiring a target voltage of a first voltage module; comparing the target voltage with a first preset voltage to obtain a comparison result; outputting, by the first voltage module, a first common voltage based on the comparison result and the first preset voltage, and sending the comparison result to a second voltage module; and outputting, by the second voltage module, a second common voltage according to the comparison result and a second preset voltage. By means of the method in this application, a fixed voltage difference is achieved by only adjusting a common voltage output by one voltage module, as a common voltage output by the other voltage module will follow based on the comparison result. In addition, this application can also improve work efficiency.

BRIEF DESCRIPTION OF THE DRAWINGS

To describe the technical solutions in the embodiments of this application or in the prior art more clearly, the following briefly introduces the accompanying drawings required for describing the embodiments or the prior art. Apparently, the accompanying drawings in the following description show merely the embodiments of this application, and a person of ordinary skill in the art may still derive other drawings from these accompanying drawings without creative efforts.

LIST OF REFERENCE NUMERALS

Figure 1:
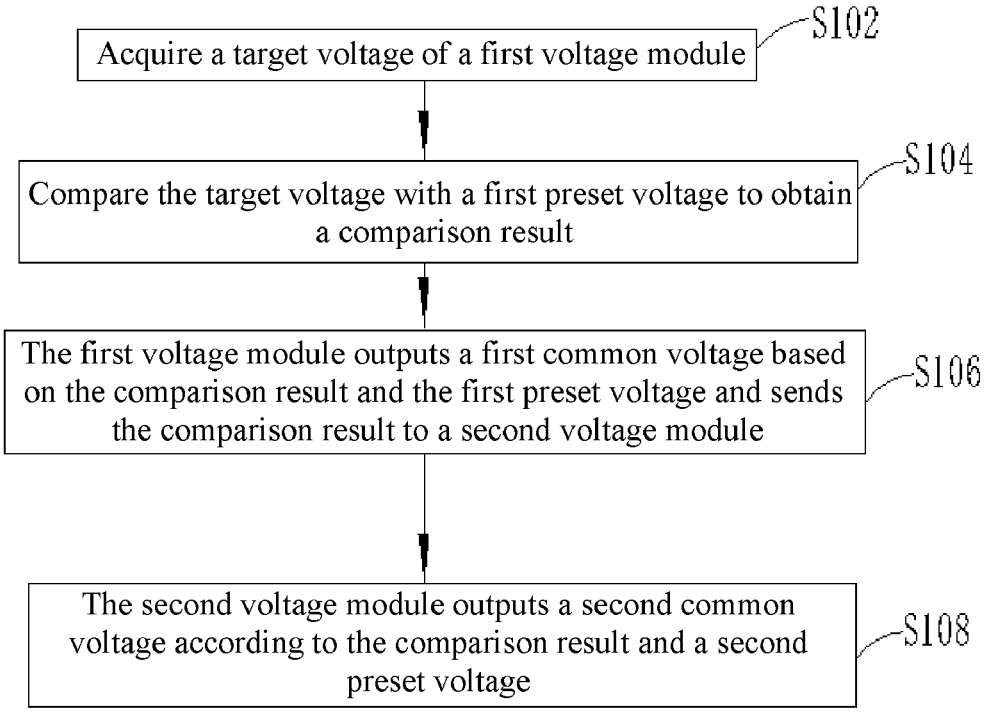
FIG. 1 is a flowchart of a method for driving a display panel according to an embodiment of this application.

10 Device for driving a display panel
100 First voltage module
110 First microcontroller unit
120 First digital-to-analog converter
130 First memory
200 Second voltage module
210 Second microcontroller unit
220 Second digital-to-analog converter
230 Second memory

DETAILED DESCRIPTION OF THE EMBODIMENTS

The following clearly and completely describes the technical solutions in the embodiments of this application with reference to the accompanying drawings in the embodiments of this application. Apparently, the described embodiments are some embodiments of this application rather than all of the embodiments. All other embodiments obtained by a person of ordinary skill in the art based on the embodiments of this application without creative efforts shall fall within the protection scope of this application.

Embodiments of this application disclose a method and device for driving a display panel. A fixed voltage difference is achieved by adjusting a common voltage output by one voltage module, as a common voltage output by the other voltage module will automatically follow.

Referring to FIG. 1, an embodiment of this application provides a method for driving a display panel, including the following steps.

S102: A target voltage of a first voltage module 100 is acquired.

It can be understood that a specific value of the target voltage is not defined particularly, provided that it is the target voltage of the first voltage module 100. In an embodiment, the target voltage may be 6V. In an embodiment, the target voltage may be 6.5V. The specific value of the target voltage may be set as needed.

It can be understood that a manner of acquiring the target voltage is not limited, provided that the target voltage of the first voltage module 100 can be acquired. In an embodiment, the target voltage may be acquired using a voltmeter. In an embodiment, the target voltage may be acquired using an oscilloscope. The manner of acquiring the target voltage may be selected as needed.

S104: The target voltage is compared with a first preset voltage to obtain a comparison result.

It can be understood that a specific value of the first preset voltage is not defined particularly, provided that the comparison result can be obtained based on the first preset voltage. In an embodiment, the first preset voltage may be set to 5V. In an embodiment, the first preset voltage may be set to 7V. The specific value of the first preset voltage may be selected as needed.

It can be understood that a manner of comparing the target voltage with the first preset voltage is not limited, provided that the comparison result can be obtained. In an embodiment, a difference comparison may be performed on the target voltage and the first preset voltage to obtain a difference result. In an embodiment, a division comparison may be performed on the target voltage and the first preset voltage to obtain a division result. A specific manner of comparing the target voltage with the first preset voltage may be selected as needed. In an embodiment, a first processor may be used to compare the target voltage with the first preset voltage to obtain the comparison result.

S106: The first voltage module 100 outputs a first common voltage based on the comparison result and the first preset voltage and sends the comparison result to a second voltage module 200.

The first voltage module 100 outputs the first common voltage after performing a data operation on the comparison result and the first preset voltage. Specifically, the data operation is performed on the comparison result and the first preset voltage according to a design principle of a hardware circuit, i.e., $$V_1 = a * \frac{VREF}{2^n} + \Delta V,$$

where $V_1$ is the first common voltage, a is the first preset voltage, VREF (voltage reference) refers to a reference voltage, and $\Delta V$ is the comparison result. At the same time, the comparison result is sent to the second voltage module 200 after data conversion is performed on the comparison result.

S108: The second voltage module 200 outputs a second common voltage according to the comparison result and a second preset voltage.

It can be understood that a specific value of the second preset voltage is not defined particularly, provided that the second common voltage can be output based on the second preset voltage. In an embodiment, the second preset voltage may be set to 5V. In an embodiment, the second preset voltage may be set to 7V. The specific value of the second preset voltage may be selected as needed.

The second voltage module 200 acquires the comparison result sent by the first voltage module 100, performs a data operation on the comparison result and the second preset voltage according to a design principle of a hardware circuit, and finally outputs the second common voltage. That is, the second voltage module 200 synchronously acquires a voltage variation value (i.e., the comparison result) of the first voltage module 100, and outputs the second common voltage according to the voltage variation value and the second preset voltage. In this way, not only the second voltage module 200 and the first voltage module 100 can be interlinked, but also a fixed voltage difference can be achieved.

In this embodiment, by means of such method, a fixed voltage difference is achieved by only adjusting a common voltage output by one voltage module (i.e., the first voltage module 100), as a common voltage output by the other voltage module (i.e., the second voltage module 200) will automatically follow based on the comparison result. In addition, this application can also improve work efficiency.

In an embodiment, the step of comparing the target voltage with the first preset voltage to obtain the comparison result includes: acquiring the first preset voltage; and comparing the first preset voltage with the target voltage to obtain the comparison result.

It can be understood that a specific value of the first preset voltage is not defined particularly, provided that the comparison result can be obtained based on the first preset voltage. In an embodiment, the first preset voltage may be set to 5V. In an embodiment, the first preset voltage may be set to 7V. The specific value of the first preset voltage may be selected as needed.

In an embodiment, the manner of comparing the first preset voltage with the target voltage may be selected from a difference comparison or a division comparison. In an embodiment, when the comparison manner is the difference comparison, a difference comparison result can be obtained by subtracting the first preset voltage from the target voltage and taking an absolute value. In an embodiment, when the comparison manner is the division comparison, a division comparison result can be obtained by dividing the first preset voltage by the target voltage.

In an embodiment, the step of comparing the first preset voltage with the target voltage to obtain the comparison result includes: performing a difference comparison or a division comparison on the first preset voltage and the target voltage to obtain a difference comparison result or a division comparison result. Either of the difference comparison or the division comparison may be used, provided that the comparison result can be obtained, and the first voltage module 100 can output the first common voltage based on the comparison result and the first preset voltage.

In an embodiment, the step of outputting, by the first voltage module 100, the first common voltage based on the comparison result and the first preset voltage and sending the comparison result to the second voltage module 200 includes: outputting, by the first voltage module 100, a first target voltage based on the comparison result and the first preset voltage; outputting the first common voltage after performing data conversion on the first target voltage; and sending the comparison result to the second voltage module 200 after performing data processing on the comparison result.

The performing data conversion on the first target voltage refers to performing digital-to-analog conversion on the first target voltage, i.e., converting the first target voltage from a digital voltage signal to an analog voltage signal. The performing data processing on the comparison result refers to performing data encryption on the comparison result according to a preset communication protocol and sending the encrypted comparison result to the second voltage module 200.

In an embodiment, the step of outputting a first common voltage after performing data conversion on the first target voltage includes: performing digital-to-analog conversion on the first target voltage based on a first preset reference voltage, to obtain the first common voltage; and outputting the first common voltage.

In an embodiment, a value of the first preset reference voltage is not defined particularly, provided that digital-to-analog conversion can be performed on the first target voltage based on the first preset reference voltage. In an embodiment, the value of the first preset reference voltage may be 13V. In an embodiment, the value of the first preset reference voltage may be 15V. In an embodiment, a digital-to-analog converter may be used to convert the first target voltage from the digital voltage signal to the analog voltage signal and output the analog voltage signal (i.e., output the first common voltage).

In an embodiment, the step of outputting, by the second voltage module 200, a second common voltage according to the comparison result and a second preset voltage includes: acquiring, by the second voltage module 200, the second preset voltage; and performing, by the second voltage module 200, data processing on the comparison result and the second preset voltage and outputting the second common voltage.

It can be understood that a specific value of the second preset voltage is not defined particularly, provided that the second common voltage can be output based on the second preset voltage. In an embodiment, the second preset voltage may be set to 5V. In an embodiment, the second preset voltage may be set to 7V. The specific value of the second preset voltage may be selected as needed.

The performing, by the second voltage module 200, the data processing on the comparison result and the second preset voltage refers to decrypting, by the second voltage module 200, the comparison result according to the preset communication protocol, and outputting the second common voltage according to the second preset voltage and the decrypted comparison result.

In an embodiment, the step of performing, by the second voltage module 200, the data processing on the comparison result and the second preset voltage and outputting the second common voltage includes: outputting, by the second voltage module 200, a second target voltage based on the comparison result and the second preset voltage; and performing digital-to-analog conversion on the second target voltage based on a second preset reference voltage to obtain the second common voltage, and outputting the second common voltage.

In an embodiment, a value of the second preset reference voltage is not defined particularly, provided that digital-to-analog conversion can be performed on the second target voltage based on the second preset reference voltage. In an embodiment, the value of the second preset reference voltage may be 13V. In an embodiment, the value of the second preset reference voltage may be 15V. In an embodiment, a digital-to-analog converter may be used to convert the second target voltage from a digital voltage signal to an analog voltage signal and output the analog voltage signal (i.e., output the second common voltage).

Figure 2:
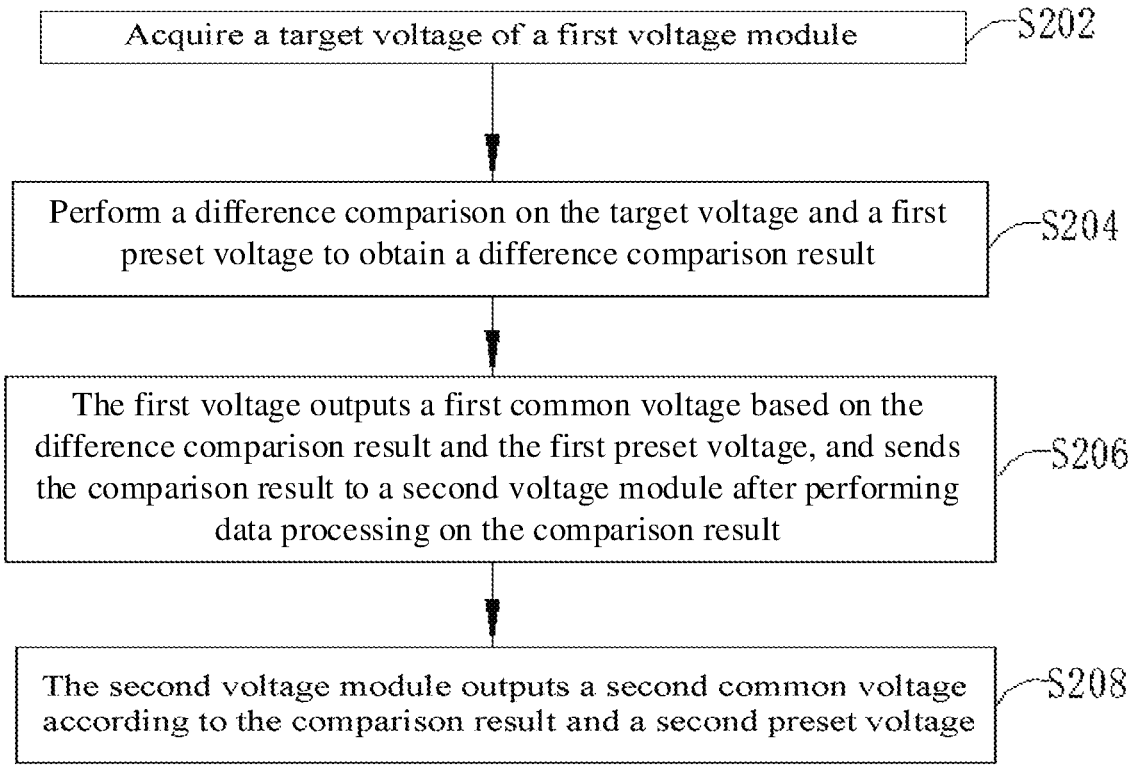
FIG. 2 is a flowchart of a method for driving a display panel according to another embodiment of this application.

Referring to FIG. 2, an embodiment of this application provides a method for driving a display panel, including the following steps.

S202: A target voltage of a first voltage module 100 is acquired.

It can be understood that a specific value of the target voltage is not defined particularly, provided that it is the target voltage of the first voltage module 100. In an embodiment, the target voltage may be 6V. In an embodiment, the target voltage may be 6.5V. The specific value of the target voltage may be set as needed.

It can be understood that a manner of acquiring the target voltage is not limited, provided that the target voltage of the first voltage module 100 can be acquired. In an embodiment, the target voltage may be acquired using a voltmeter. In an embodiment, the target voltage may be acquired using an oscilloscope. The manner of acquiring the target voltage may be selected as needed.

S204: A difference comparison is performed on the target voltage and a first preset voltage to obtain a difference comparison result.

It can be understood that a specific value of the first preset voltage is not defined particularly, provided that the difference comparison result can be obtained based on the first preset voltage. In an embodiment, the first preset voltage may be set to 5V. In an embodiment, the first preset voltage may be set to 7V. The specific value of the first preset voltage may be selected as needed.

S206: The first voltage module 100 outputs a first common voltage based on the difference comparison result and the first preset voltage, and sends the difference comparison result to a second voltage module 200 after performing data processing on the difference comparison result.

The first voltage module 100 outputs the first common voltage after performing a data operation on the difference comparison result and the first preset voltage. Specifically, the data operation is performed on the difference comparison result and the first preset voltage according to a design principle of a hardware circuit, i.e., $$V_1 = a * \frac{VREF}{2^n} + \Delta V,$$

where $V_1$ is the first common voltage, a is the first preset voltage, VREF (voltage reference) refers to a reference voltage, and ΔV is the difference comparison result. At the same time, the difference comparison result is sent to the second voltage module 200 after data conversion is performed on the difference comparison result.

S208: The second voltage module 200 outputs a second common voltage according to the difference comparison result and a second preset voltage.

It can be understood that a specific value of the second preset voltage is not defined particularly, provided that the second common voltage can be output based on the second preset voltage. In an embodiment, the second preset voltage may be set to 5V. In an embodiment, the second preset voltage may be set to 7V. The specific value of the second preset voltage may be selected as needed.

The second voltage module 200 acquires the difference comparison result sent by the first voltage module 100, performs a data operation on the difference comparison result and the second preset voltage according to a design principle of a hardware circuit, and finally outputs the second common voltage. That is, the second voltage module 200 synchronously acquires a voltage variation value (i.e., the difference comparison result) of the first voltage module 100, and outputs the second common voltage according to the voltage variation value and the second preset voltage. In this way, not only the second voltage module 200 and the first voltage module 100 can be interlinked, but also a fixed voltage difference can be achieved.

In this embodiment, by means of such method, a fixed voltage difference is achieved by only adjusting a common voltage of one voltage module (i.e., the first voltage module 100), as a common voltage output by the other voltage module (i.e., the second voltage module 200) will automatically follow based on the comparison result. In addition, this application can also improve work efficiency.

According to this application, in practical use:

Firstly, the target voltage of the first voltage module 100 is acquired, then a difference comparison is performed on the target voltage (a1) and the first preset voltage (a), and an operation and conversion are performed according to a design principle of a hardware circuit, thus obtaining a voltage variation value ΔV=a1−a (i.e., the difference comparison result). The first common voltage is represented by $$V_1 = a * \frac{VREF}{2^n} + \Delta V.$$

Since voltage output formulas set for different voltage modules vary, an actual voltage variation value ΔV needs to be converted to a digital representation Δcode according to the preset communication protocol. Specifically, for example, a 7-bit code is set, with the former 3 bits representing a voltage variation value at an integer place, and the latter 4 bits representing a voltage variation value at a decimal place. The first voltage module 100 then sends the Δcode to the second voltage module 200. The second voltage module 200 decodes the Δcode according to the preset communication protocol, thus obtaining the voltage variation value ΔV of the first voltage module 100. In this way, the voltage variation value of the first voltage module 100 is synchronously transferred to the second voltage module 200.

The second voltage module 200 then performs a data operation on the voltage variation value ΔV and the second preset voltage according to a design principle of a hardware circuit, and finally outputs the second common voltage. In this way, not only the second voltage module 200 and the first voltage module 100 can be interlinked, but also a fixed voltage difference can be achieved.

To sum up, by means of the method in this application, a fixed voltage difference is achieved by only adjusting a common voltage output by one voltage module, as a common voltage output by the other voltage module will follow based on the comparison result. In addition, this application can also improve work efficiency.

Figure 3:
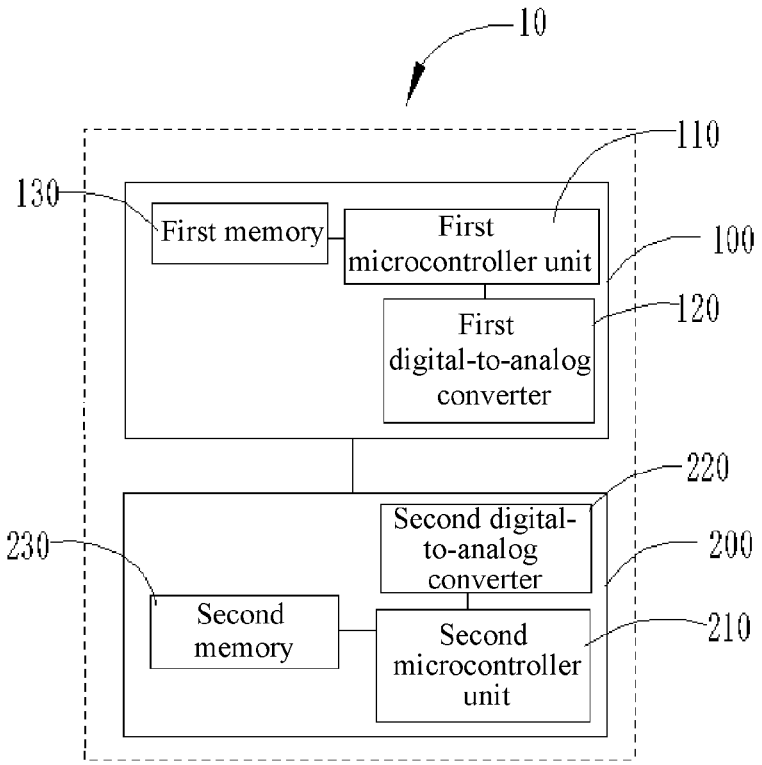
FIG. 3 is a structural block diagram of a device for driving a display panel according to an embodiment of this application.

Referring to FIG. 3, an embodiment of this application provides a device for driving a display panel, including a first voltage module 100 and a second voltage module 200. The first voltage module 100 is configured to acquire a target voltage and compare the target voltage with a first preset voltage to obtain a comparison result. The first voltage module is further configured to output a first common voltage based on the comparison result and the first preset voltage and send the comparison result to the second voltage module 200. The second voltage module 200 is communicatively connected to the first voltage module 100. The second voltage module 200 outputs a second common voltage according to the comparison result and a second preset voltage.

It can be understood that a specific configuration of the first voltage module 100 is not limited, provided that capabilities of comparing the acquired target voltage to the first preset voltage and outputting the first common voltage based on the comparison result and the first preset voltage are provided. In an embodiment, the first voltage module 100 may be formed by a first microcontroller unit (MCU) 110, a first digital-to-analog converter 120, and a first memory 130. In an embodiment, the MCU may be replaced with a processor.

It can be understood that a specific configuration of the second voltage module 200 is not limited, provided that a capability of outputting the second common voltage according to the comparison result and the second preset voltage is provided. In an embodiment, the second voltage module 200 may consist of a second microcontroller unit (MCU) 210, a second digital-to-analog converter 220, and a second memory 230. In an embodiment, the MCU may be replaced with a processor.

Finally, it should be noted that the relational terms herein such as first and second are used only to differentiate an entity or operation from another entity or operation, and do not require or imply any actual relationship or sequence between these entities or operations. Moreover, the terms "include", "comprise", and any variant thereof are intended to cover a non-exclusive inclusion. Therefore, in the context of a process, method, object, or device that includes a series of elements, the process, method, object, or device not only includes such elements, but also includes other elements not specified expressly, or may include inherent elements of the process, method, object, or device. Without further limitation, the element defined by a phrase "include one . . . " does not exclude other same elements in the process, method, article or device which includes the element.

It should be noted that the embodiments in this specification are all described in a progressive manner. Description of each of the embodiments focuses on differences from other embodiments, and reference may be made to each other for the same or similar parts among respective embodiments.

The above description of the disclosed embodiments enables a person skilled in the art to implement or use this application. Various modifications to these embodiments are obvious to a person skilled in the art, and the general principles defined herein may be implemented in other embodiments without departing from the spirit and scope of this application. Therefore, this application is not limited to these embodiments illustrated herein, but needs to conform to the broadest scope consistent with the principles and novel features disclosed herein.

What is claimed is:

1. A method for driving a display panel, comprising:

acquiring a target voltage of a first voltage module;

comparing the target voltage with a first preset voltage to obtain a comparison result;

outputting, by the first voltage module, a first target voltage based on the comparison result and the first preset voltage;

outputting a first common voltage after performing data conversion on the first target voltage;

sending the comparison result to a second voltage module after performing data processing on the comparison result; and outputting, by the second voltage module, a second common voltage according to the comparison result and a second preset voltage.

2. The method according to claim 1, wherein comparing the target voltage with a first preset voltage to obtain the comparison result comprises:

acquiring the first preset voltage; and comparing the first preset voltage with the target voltage to obtain the comparison result.

3. The method according to claim 2, wherein comparing the first preset voltage with the target voltage to obtain the comparison result comprises:

performing a difference comparison on the first preset voltage and the target voltage to obtain a difference result.

4. The method according to claim 2, wherein comparing the first preset voltage with the target voltage to obtain the comparison result comprises:

performing a division comparison on the first preset voltage and the target voltage to obtain a division result.

5. The method according to claim 1, wherein outputting the first common voltage after performing data conversion on the first target voltage comprises:

performing digital-to-analog conversion on the first target voltage based on a first preset reference voltage, to obtain the first common voltage; and outputting the first common voltage.

6. The method according to claim 1, wherein sending the comparison result to the second voltage module after performing data processing on the comparison result comprises:

performing data encryption on the comparison result according to a preset communication protocol; and sending the encrypted comparison result to the second voltage module.

7. The method according to claim 1, wherein outputting, by the second voltage module, the second common voltage according to the comparison result and the second preset voltage comprises:

acquiring, by the second voltage module, the second preset voltage; and performing, by the second voltage module, data processing on the comparison result and the second preset voltage and outputting the second common voltage.

8. The method according to claim 7, wherein performing, by the second voltage module, the data processing on the comparison result and the second preset voltage and outputting the second common voltage comprises:

outputting, by the second voltage module, a second target voltage based on the comparison result and the second preset voltage; and performing digital-to-analog conversion on the second target voltage based on a second preset reference voltage to obtain the second common voltage, and outputting the second common voltage.

9. A method for driving a display panel, comprising:

acquiring a target voltage of a first voltage module;

performing a difference comparison on the target voltage and a first preset voltage to obtain a difference comparison result;

outputting, by the first voltage module, a first common voltage based on the difference comparison result and the first preset voltage, and sending the difference comparison result to a second voltage module after performing data processing on the difference comparison result;

acquiring, by the second voltage module, a second preset voltage; and performing, by the second voltage module, data processing on the difference comparison result and the second preset voltage, and outputting a second common voltage.

10. The method according to claim 9, wherein performing the difference comparison on the target voltage and the first preset voltage to obtain the difference comparison result comprises:

acquiring the first preset voltage; and performing the difference comparison on the first preset voltage and the target voltage to obtain the difference comparison result.

11. The method according to claim 9, wherein performing the difference comparison on the target voltage and the first preset voltage to obtain the difference comparison result can be replaced with:

performing a division comparison on the first preset voltage and the target voltage to obtain a division comparison result.

12. The method according to claim 9, wherein outputting, by the first voltage module, the first common voltage based on the difference comparison result and the first preset voltage, and sending the difference comparison result to the second voltage module after performing the data processing on the difference comparison result comprises:

outputting, by the first voltage module, a first target voltage based on the difference comparison result and the first preset voltage;

outputting the first common voltage after performing data conversion on the first target voltage; and sending the difference comparison result to the second voltage module after performing data processing on the difference comparison result.

13. The method according to claim 12, wherein outputting the first common voltage after performing the data conversion on the first target voltage comprises:

performing digital-to-analog conversion on the first target voltage based on a first preset reference voltage, to obtain the first common voltage; and outputting the first common voltage.

14. The method according to claim 12, wherein sending the difference comparison result to the second voltage module after performing the data processing on the difference comparison result comprises:

performing data encryption on the difference comparison result according to a preset communication protocol; and sending the encrypted difference comparison result to the second voltage module.

15. The method according to claim 9, wherein performing, by the second voltage module, the data processing on the difference comparison result and the second preset voltage, and outputting the second common voltage comprises:

outputting, by the second voltage module, a second target voltage based on the difference comparison result and the second preset voltage; and performing digital-to-analog conversion on the second target voltage based on a second preset reference voltage to obtain the second common voltage, and outputting the second common voltage.

16. A device for driving a display panel, comprising:

a first voltage module, configured to acquire a target voltage and compare the target voltage with a first preset voltage to obtain a comparison result, wherein:

the first voltage module is further configured to output a first target voltage based on the comparison result and the first preset voltage; output a first common voltage after performing data conversion on the first target voltage; and send the comparison result to a second voltage module after performing data processing on the comparison result; and the second voltage module is communicatively connected to the first voltage module and configured to output a second common voltage according to the comparison result and a second preset voltage.

17. The device according to claim 16, wherein the first voltage module comprises a first microcontroller unit, a first digital-to-analog converter, and a first memory, and both the first digital-to-analog converter and the first memory are connected to the first microcontroller unit.

18. The device according to claim 16, wherein the second voltage module comprises a second microcontroller unit, a second digital-to-analog converter, and a second memory, and both the second digital-to-analog converter and the second memory are connected to the second microcontroller unit.

19. The device according to claim 16, wherein, in terms of outputting the first common voltage after performing data conversion on the first target voltage, the first voltage module is configured to:

perform digital-to-analog conversion on the first target voltage based on a first preset reference voltage, to obtain the first common voltage; and output the first common voltage.

20. The device according to claim 16, wherein, in terms of sending the comparison result to the second voltage module after performing data processing on the comparison result, the first voltage module is configured to:

perform data encryption on the comparison result according to a preset communication protocol; and send the encrypted comparison result to the second voltage module.

* * * * *